US009603200B1

(12) United States Patent
Bennett

(10) Patent No.: US 9,603,200 B1
(45) Date of Patent: Mar. 21, 2017

(54) PORTABLE WINDSHIELD DEFROSTER

(71) Applicant: Camille Bennett, Harrisburg, PA (US)

(72) Inventor: Camille Bennett, Harrisburg, PA (US)

( * ) Notice: Subject to any disclaimer, the term of this patent is extended or adjusted under 35 U.S.C. 154(b) by 179 days.

(21) Appl. No.: 14/612,778

(22) Filed: Feb. 3, 2015

(51) Int. Cl.

| | |
|---|---|
| ***A45D 20/10*** | (2006.01) |
| ***F24D 15/02*** | (2006.01) |
| ***F24H 3/00*** | (2006.01) |
| ***H05B 3/84*** | (2006.01) |
| ***F24H 9/00*** | (2006.01) |

(52) U.S. Cl.
CPC ..... *H05B 3/84* (2013.01); *F24H 9/0073* (2013.01)

(58) Field of Classification Search
None
See application file for complete search history.

(56) References Cited

U.S. PATENT DOCUMENTS 1,933,220 A * 10/1933 Petree ..... B60S 1/54 15/250.05
2,121,753 A * 6/1938 Cornell, Jr. ..... B60S 1/54 15/300.1
2,121,754 A * 6/1938 Cornell, Jr. ..... B60S 1/54 15/313
2,165,615 A * 7/1939 Cope ..... B60H 1/00264 165/126
2,675,459 A * 4/1954 Pace ..... A47L 15/486 34/201
2,779,856 A * 1/1957 Fahner ..... H05B 3/00 219/213
2,820,450 A * 1/1958 Zimmerman ..... E01H 5/106 126/271.2 A
3,115,567 A * 12/1963 Meltzer ..... B44D 3/168 34/201
3,177,794 A * 4/1965 Laing ..... B60H 1/00471 239/590.5
3,211,890 A * 10/1965 Graves ..... A47L 1/16 219/202
3,331,940 A * 7/1967 Reid, Jr. ..... B60H 1/00264 165/129
3,362,469 A * 1/1968 Erling ..... F24F 9/00 165/122
3,418,452 A * 12/1968 Grabner ..... A47K 10/48 34/97
3,796,209 A * 3/1974 Luft ..... A01G 13/06 126/59.5
4,037,079 A * 7/1977 Armbruster ..... H05B 3/845 219/203
4,197,447 A * 4/1980 Jones ..... H05B 3/008 126/110 R
4,366,368 A * 12/1982 Stephens, III ..... F24H 3/062 15/405
4,593,179 A * 6/1986 Schulz ..... F24H 3/0405 137/341
4,637,298 A * 1/1987 Yoshikawa ..... B60H 1/3407 454/127

(Continued)

FOREIGN PATENT DOCUMENTS

WO WO2007003673 A2 1/2007

*Primary Examiner* — Thor Campbell
(74) *Attorney, Agent, or Firm* — Kyle A. Fletcher, Esq.

(57) ABSTRACT

The portable windshield defroster is a device that sits on the exterior side of a windshield and melts snow and ice that has accumulated on the windshield. The portable windshield defroster is powered either through the automobile electrical system or through solar panels.

14 Claims, 6 Drawing Sheets

(56) References Cited

U.S. PATENT DOCUMENTS 4,874,921 A * 10/1989 Gerbig, Jr. ..... B60H 1/00264 219/202
4,916,287 A * 4/1990 Soden ..... B60H 1/0025 219/202
4,965,432 A * 10/1990 Harris ..... B60H 1/0025 219/203
4,988,847 A * 1/1991 Argos ..... A47G 1/02 165/86
5,025,130 A * 6/1991 Slone ..... B60H 1/00264 219/203
5,155,924 A * 10/1992 Smith ..... E04B 1/7092 15/405
5,251,281 A * 10/1993 Fravel, Jr. ..... F24H 3/0423 126/271.1
5,296,678 A * 3/1994 Schnorf ..... B60H 1/2225 165/42
D353,885 S 12/1994 Hydak
5,394,620 A * 3/1995 Chimera ..... A45D 20/30 34/97
5,463,203 A * 10/1995 Moore ..... H05B 3/32 219/202
5,787,228 A * 7/1998 Fiely ..... B60H 1/00264 219/203
5,844,202 A * 12/1998 Alverson ..... B60H 1/00264 219/202
5,867,926 A * 2/1999 Schmitt ..... E01H 5/106 37/227
5,884,007 A * 3/1999 Fein ..... B60H 1/2225 219/202
6,167,193 A * 12/2000 Birdsell ..... F24H 9/2071 219/506
6,197,263 B1 * 3/2001 Blount ..... A61L 9/03 392/390
6,215,955 B1 * 4/2001 Sloan ..... B29C 73/34 219/202
6,304,720 B1 * 10/2001 Richard ..... B29C 61/00 239/601
7,231,140 B2 * 6/2007 Dolton, III ..... E01H 5/106 219/213
7,471,883 B2 * 12/2008 Seutter ..... A47K 10/48 34/90
7,639,928 B2 * 12/2009 Coke ..... F24H 3/0417 392/347
8,129,662 B2 * 3/2012 Cameron ..... F24D 15/02 126/110 R
2006/0083493 A1 * 4/2006 Dolton, III ..... E01H 5/106 392/384
2008/0085103 A1 * 4/2008 Beland ..... A61L 9/035 392/390
2008/0193111 A1 * 8/2008 Seutter ..... F24H 3/0417 392/381
2008/0240689 A1 * 10/2008 Coke ..... F24H 3/0417 392/367
2013/0259456 A1 * 10/2013 Viswanathan ..... F24D 13/00 392/407
2014/0112648 A1 * 4/2014 Reinders ..... A01G 9/14 392/347
2014/0284022 A1 * 9/2014 Maxbauer ..... B60H 1/2218 165/41

* cited by examiner

PORTABLE WINDSHIELD DEFROSTER

CROSS REFERENCES TO RELATED APPLICATIONS

Not Applicable

STATEMENT REGARDING FEDERALLY SPONSORED RESEARCH

Not Applicable

REFERENCE TO APPENDIX

Not Applicable

BACKGROUND OF THE INVENTION

Field of the Invention

The present invention relates to the field of automobile windshields and automobile windshield defrosters, more specifically, a portable windshield defroster.

SUMMARY OF INVENTION

The portable windshield defroster is a device that sits on the exterior side of a windshield and melts snow and ice that has accumulated on the windshield. The portable windshield defroster is powered either through the automobile electrical system or through solar panels.

These together with additional objects, features and advantages of the portable windshield defroster will be readily apparent to those of ordinary skill in the art upon reading the following detailed description of the presently preferred, but nonetheless illustrative, embodiments when taken in conjunction with the accompanying drawings.

In this respect, before explaining the current embodiments of the portable windshield defroster in detail, it is to be understood that the portable windshield defroster is not limited in its applications to the details of construction and arrangements of the components set forth in the following description or illustration. Those skilled in the art will appreciate that the concept of this disclosure may be readily utilized as a basis for the design of other structures, methods, and systems for carrying out the several purposes of the portable windshield defroster.

It is therefore important that the claims be regarded as including such equivalent construction insofar as they do not depart from the spirit and scope of the portable windshield defroster. It is also to be understood that the phraseology and terminology employed herein are for purposes of description and should not be regarded as limiting.

BRIEF DESCRIPTION OF DRAWINGS

The accompanying drawings, which are included to provide a further understanding of the invention are incorporated in and constitute a part of this specification, illustrate an embodiment of the invention and together with the description serve to explain the principles of the invention. They are meant to be exemplary illustrations provided to enable persons skilled in the art to practice the disclosure and are not intended to limit the scope of the appended claims.

DETAILED DESCRIPTION OF THE EMBODIMENT

Figure 1:
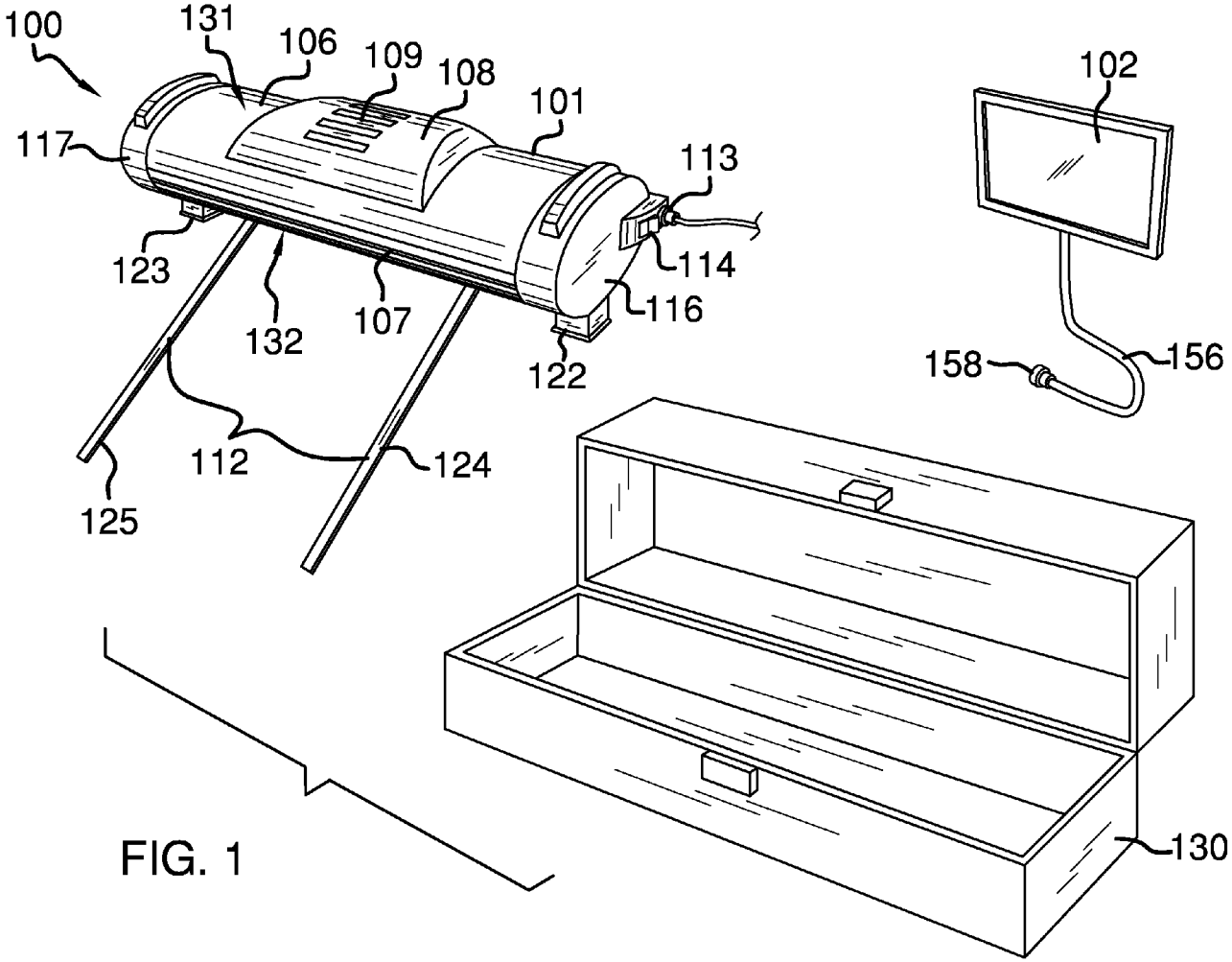
FIG. 1 is a perspective view of an embodiment of the disclosure.
Figure 2:
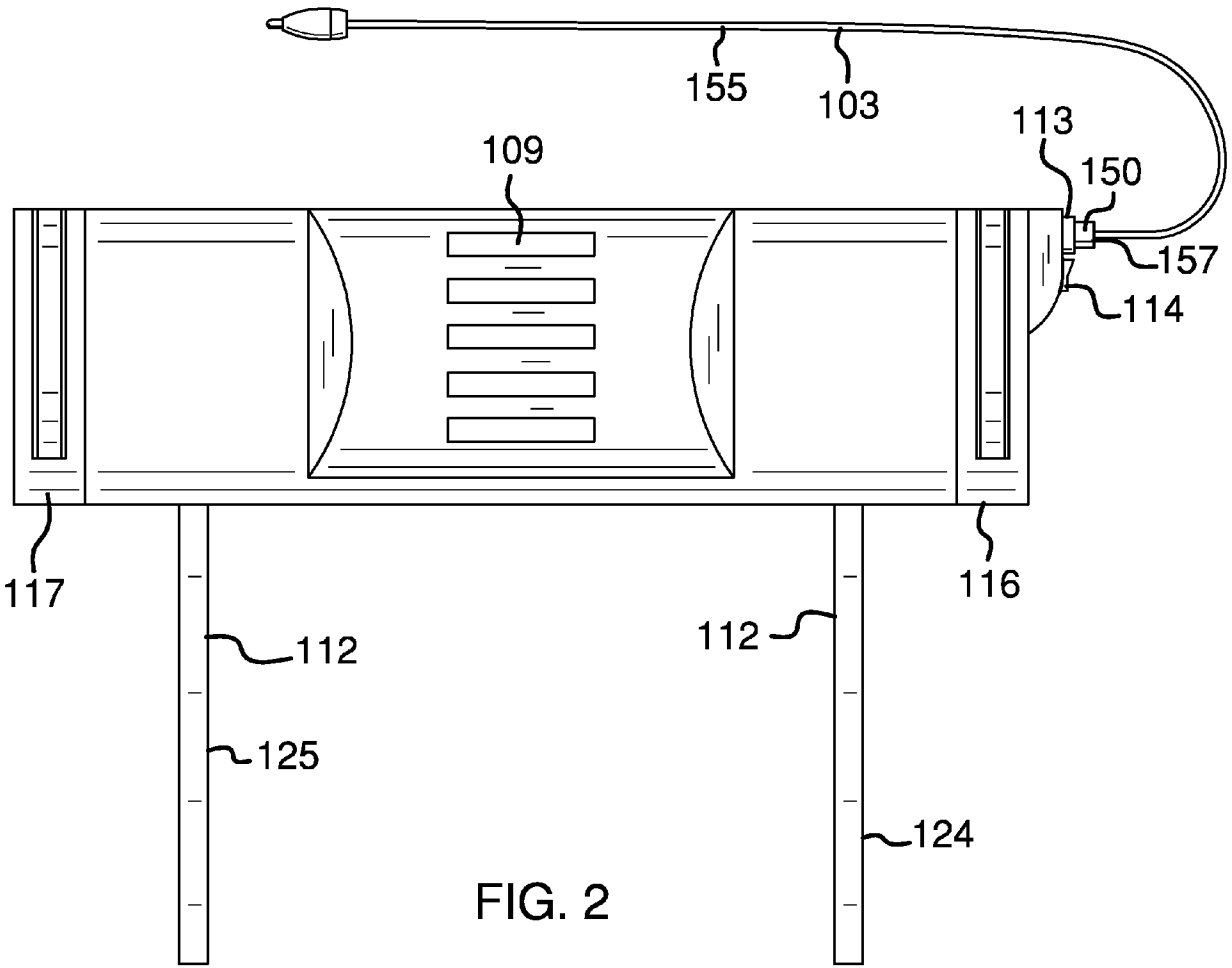
FIG. 2 is a top view of an embodiment of the disclosure.
Figure 3:
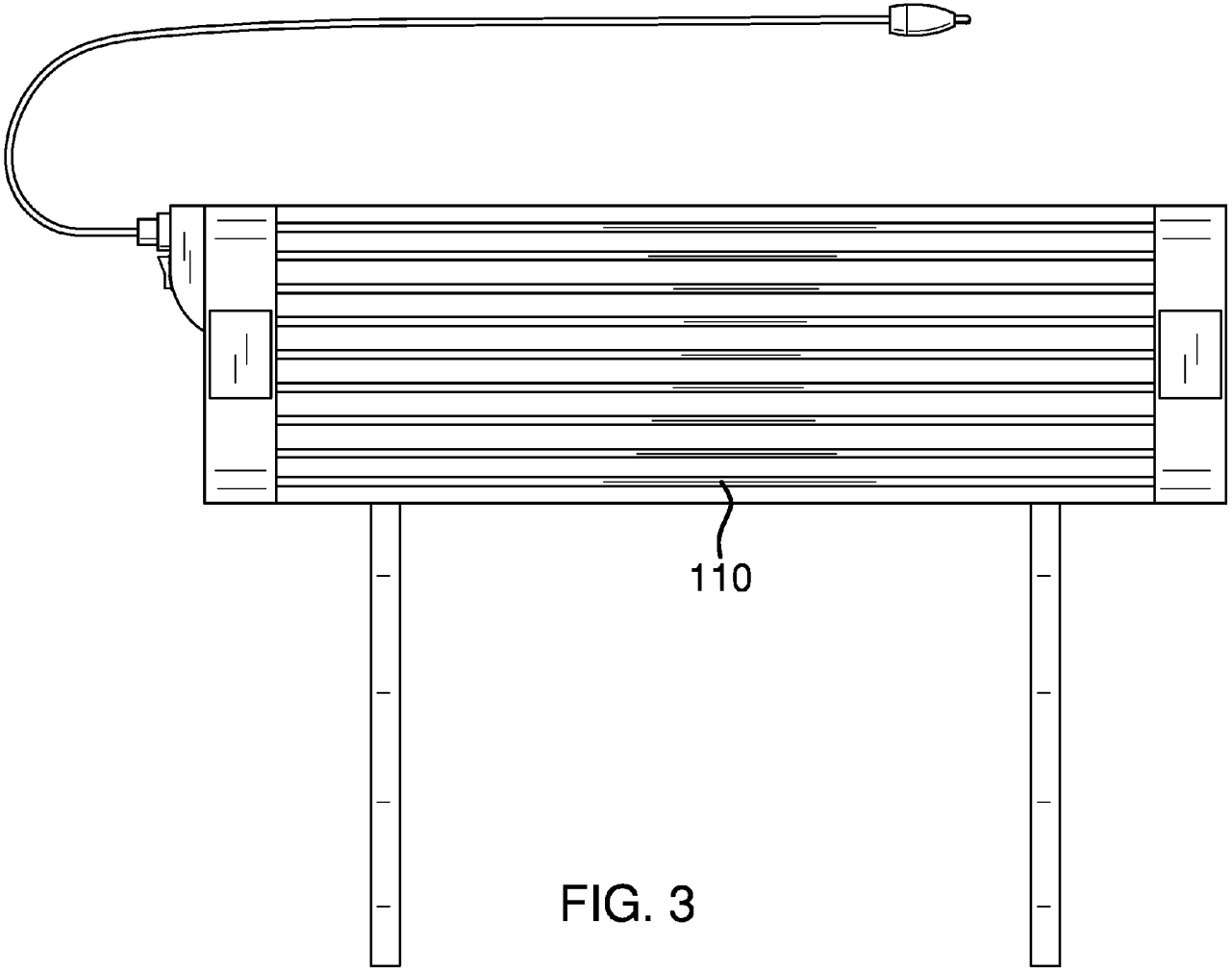
FIG. 3 is a bottom view of an embodiment of the disclosure.
Figure 4:
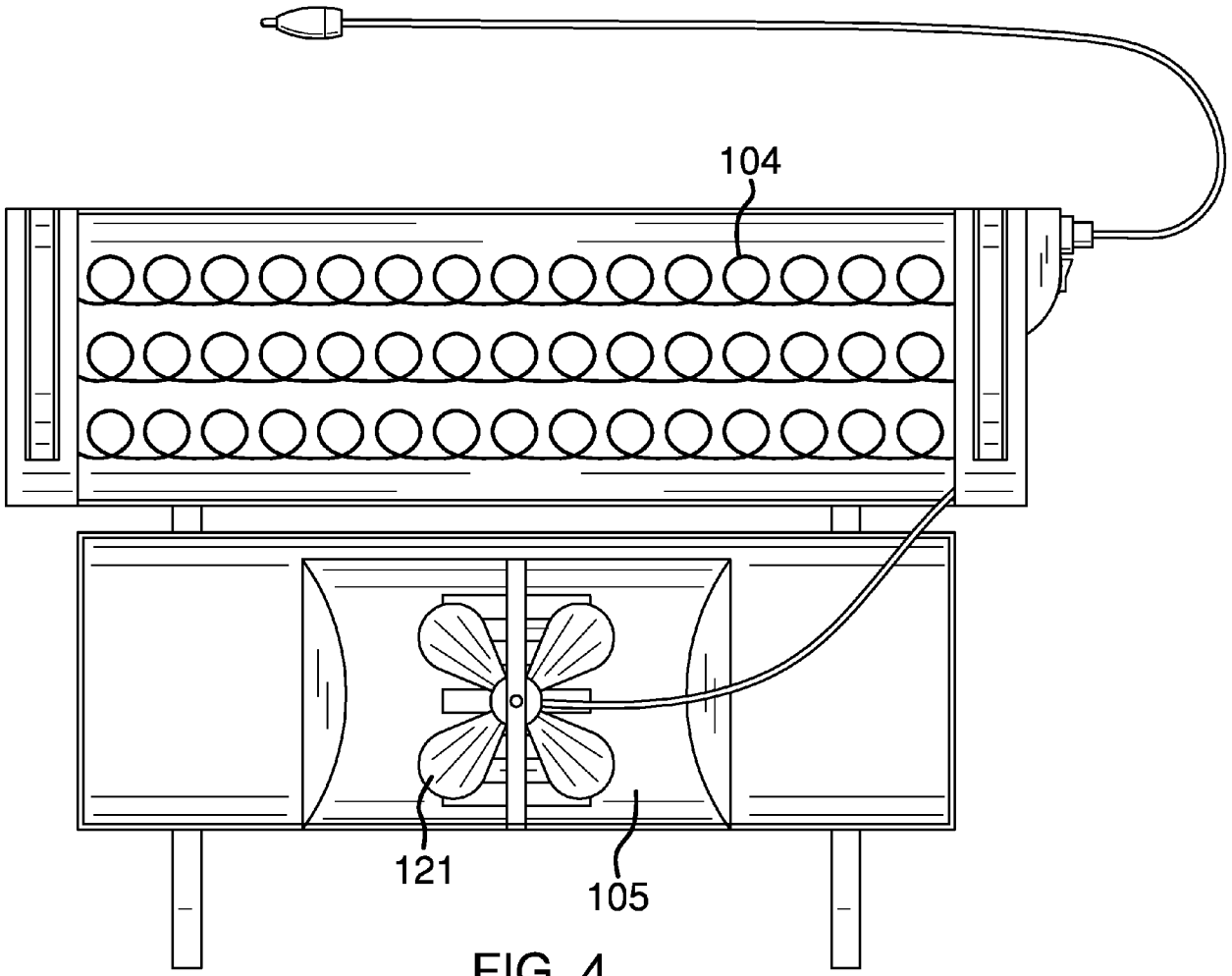
FIG. 4 is a disassembled view of an embodiment of the disclosure.
Figure 5:
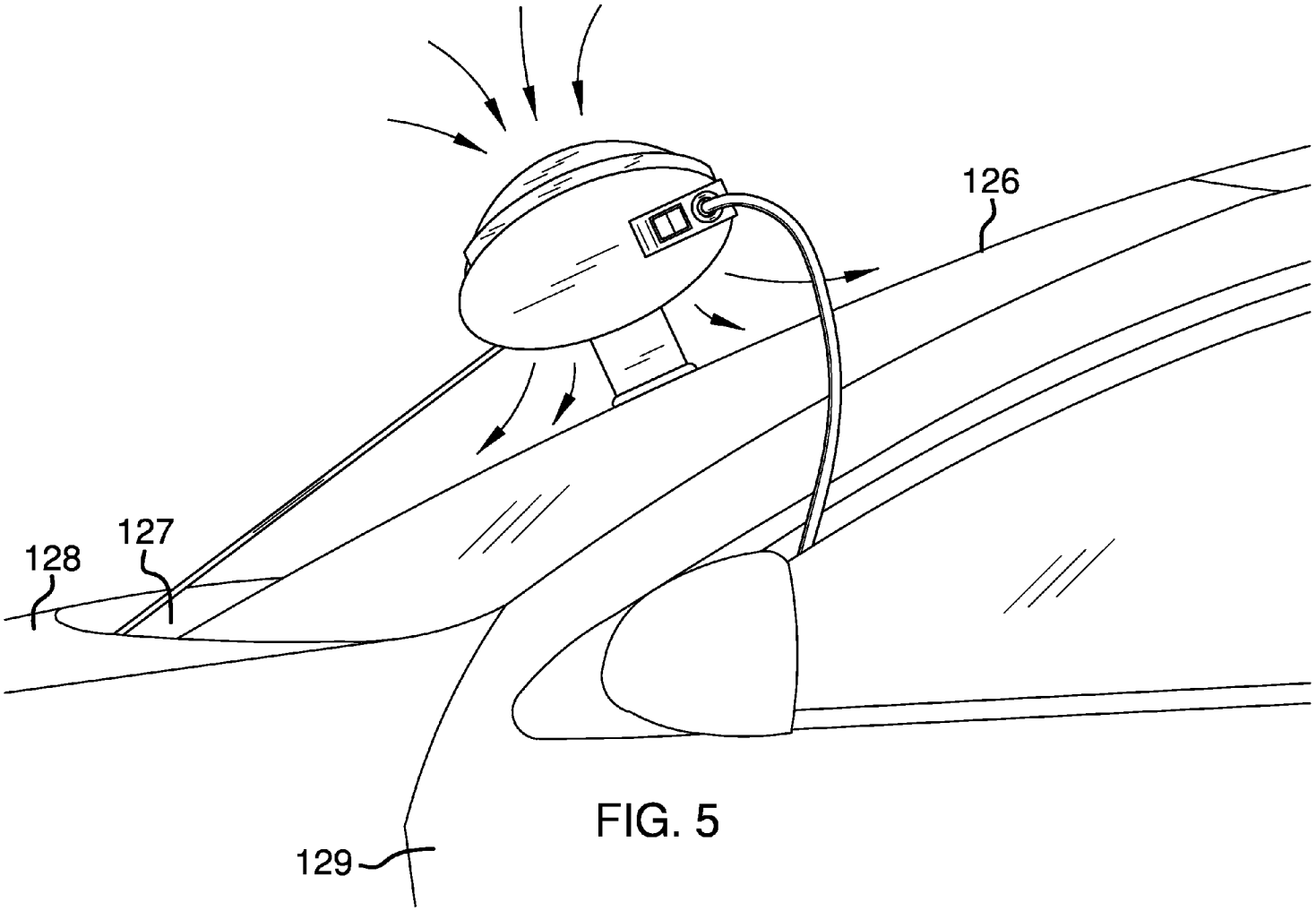
FIG. 5 is an in-use view of an embodiment of the disclosure.

The following detailed description is merely exemplary in nature and is not intended to limit the described embodiments of the application and uses of the described embodiments. As used herein, the word "exemplary" or "illustrative" means "serving as an example, instance, or illustration." Any implementation described herein as "exemplary" or "illustrative" is not necessarily to be construed as preferred or advantageous over other implementations. All of the implementations described below are exemplary implementations provided to enable persons skilled in the art to practice the disclosure and are not intended to limit the scope of the appended claims. Furthermore, there is no intention to be bound by any expressed or implied theory presented in the preceding technical field, background, brief summary or the following detailed description.

Detailed reference will now be made to a first potential embodiment of the disclosure, which is illustrated in FIGS. 1 through 5. The portable windshield defroster 100 (hereinafter invention) comprises a defroster 101, a solar panel 102, and a cigarette lighter adapter 103. The defroster 101 comprises a heating element 104, one or more fans 105, and a housing 106.

The purpose of the heating element 104 is to heat the air that will be used to defrost the windshield 126. In the first potential embodiment of the disclosure, the heating element 104 is a series of three nichrome (80% Nickel 20% Chromium) wires formed in a closed helix configuration.

The purpose of the one or more fans 105 is to draw outside air into the housing 106, and pump the outside air over the heating element 104 and onto the automobile 129 windshield 126. When the heating element 104 is powered, the one or more fans 105 are started.

The one or more fans 105 are commercially available fans. In the first potential embodiment of the disclosure, an 80 mm fan designed for use in cooling personal computers is used.

The housing 106 comprises a base structure 107, a fan ridge 108, a fan grill 109, a heat exhaust vent 110, a first end cap 116, a second end cap 117, and one or more support rods 112. The purpose of the housing 106 is to contain and support the other elements of the defroster 101.

The base structure 107 is formed in the shape of an elliptic cylinder. The purpose of the base structure 107 is to house and enclose the heating element 104, and to act as the platform to which the fan ridge 108, the heat exhaust vent 110, the first end cap 116, the second end cap 117, and the one or more support rods 112 are attached. The bottom 132 surface of the base structure 107 is formed with a heat exhaust vent 110 comprising a series of holes formed in the bottom 132 surface that allows the fan to force air over the heating element 104 and through the heat exhaust vent 110.

The fan ridge 108 is a substructure that projects away from the top 131 surface of the base structure 107 in the shape of a partial elliptical cylinder. The purpose of the fan ridge 108 is to house the one or more fans 105 and the fan grill 109. The fan grill 109 is a series of intake vents that are formed in the fan ridge 108 and allow the one or more fans 105 to draw air into the housing 106.

The first end cap 116 is a structure that is fitted with a plurality of terminating posts 141, a plurality of jumpers 140, a power connection 113, an on off switch 114, and a first lift 122.

The purpose of the power connection 113 is to distribute electrical energy to the heating element 104 and the one or more fans 105. The power connection 113 is a socket designed to receive a cylindrical connector 150, also known as a barrel tip plug. The power connection 113 is mounted in the first end cap 116. The power connection 113 delivers electrical energy through a positive feed wire 149 and an on-off switch 114 to the heating element 104 and the one or more fans 105. The electricity flows through the heating element 104 and the circuit is completed using a ground return wire 148 to connect the ground of the heating element 104 to the ground connection of the power connection 113. On the bottom 132 of the first end cap 116 is a first lift 122.

An on off switch 114 is placed in series between the power connection 113 and the heating element 104 to control the operation of the invention 100. In the first potential embodiment, the on off switch 114 is a rocker switch that is mounted near the power connection 113.

The first lift 122 is a footing that projects out from the first end cap 116. The bottom 132 surface of the first lift 122 is covered with an elastic material that prevents damage to the windshield 126. The purpose of the first lift 122 is to raise the bottom 132 surface of the invention 100 off of the windshield 126 to allow unimpeded air flow onto the windshield 126.

The purpose of the plurality of terminating posts 141 is to provide an electrical termination and physical support for each nichrome wire to be attached to. The purpose of the plurality of jumpers 140 is to provide an electrical connection between nichrome wires when more than one nichrome wire is used in the heating element 104.

The second end cap 117 is a structure that is fitted with a plurality of terminating posts 141 and a plurality of jumpers 140, and a second lift 123. On the bottom 132 of the second end cap 117 is a second lift 123. The second lift 123 is a footing that projects out from the second end cap 117. The bottom 132 surface of the second lift 123 is covered with an elastic material that prevents damage to the windshield 126. The purpose of the second lift 123 is to raise the bottom 132 surface of the invention 100 off of the windshield 126 to allow unimpeded air flow onto the windshield 126. The purpose of the plurality of terminating posts 141 is to provide an electrical termination and physical support for each nichrome wire to be attached to. The purpose of the plurality of jumpers 140 is to provide an electrical connection between nichrome wires when more than one nichrome wire is used in the heating element 104.

The purpose of the one or more support rods 112 is to position the invention 100 on the windshield 126. Each of the one or more support rods 112, is a rigid plastic bar that fits into the windshield nook 127 between the windshield 126 and the hood 128 of the automobile 129. Once the one or more support rods 112 are secured in the windshield nook 127, they serve to hold the invention 100 in place on the windshield 126.

The housing 106 of the first potential embodiment of the disclosure can be made of molded plastic formed in several components that can be fitted together including an upper component that contains the fan ridge 108, a lower component that includes the heat exhaust vent 110, the first end cap 116, the second end cap 117 and a first support rod 124 and a second support rod 125. The commercially available pins and wires can be used for the plurality of terminating posts 141 and plurality of jumpers 140 and directly installed.

Figure 6:
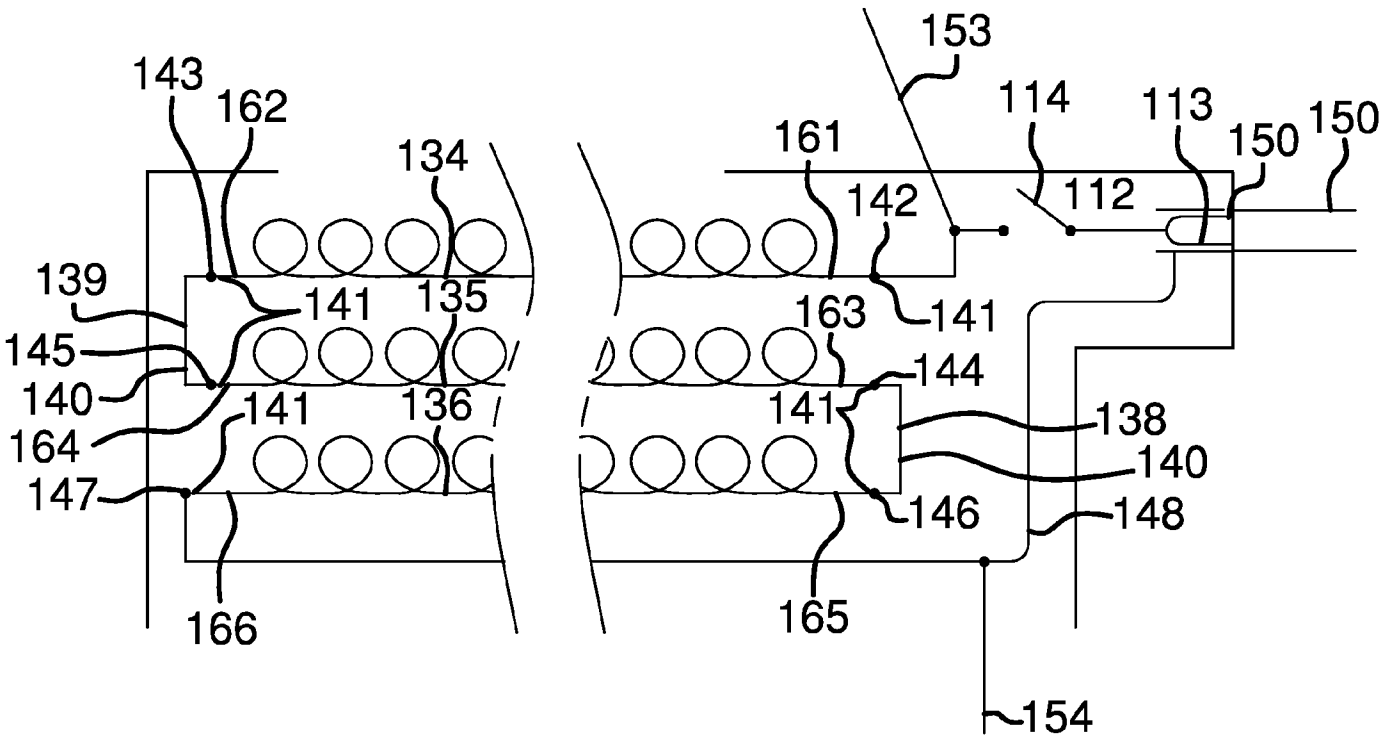
FIG. 6 is a detailed view of an embodiment of the disclosure.

The heating element 104 in the base structure 107 of the housing 106 of the first potential embodiment of the disclosure, most clearly shown in FIG. 6, is assembled as follows. A first nichrome wire 134, a second nichrome wire 135 and a third nichrome wire 136 is cut. The first nichrome wire 134 is further defined with a first end 161 and a second end 162. The second nichrome wire 135 is further defined with a third end 163 and a fourth end 164. The third nichrome wire 136 is further defined with a fifth end 165 and a sixth end 166. The first end cap 116 is fitted with a first terminating post 142, a third terminating post 144, and a fifth terminating post 146. The second end cap 117 is fitted with a second terminating post 143, a fourth terminating post 145, and a sixth terminating post 147. The first end 161 is attached to the first terminating post 142. The second end 161 is attached to the second terminating post 143. The third end 163 is attached to the third terminating post 144. The fourth end 164 is attached to the fourth terminating post 145. The fifth end 164 is attached to the fifth terminating post 146. The sixth end 166 is attached to the sixth terminating post 147. A first jumper wire 138 is used to connect the third terminating post 144 and the fifth terminating post 146. A second jumper wire 139 is used to connect the second terminating post 143 and the fourth terminating post 145. The circuit is completed by electrically connecting the first terminating post 142 to the on off switch 114 and connecting the sixth terminating post 147 to the ground return wire 148.

The first potential embodiment of the disclosure uses a first fan 121. The first fan 121 is mounted in the fan ridge 108 using commercially available hardware. Electrically, the first fan 121 is connected to the on off switch 114 using the fan lead 153. The circuit is completed by attaching a fan return lead 154 to the ground return wire 148.

Electrical power is provided to the invention 100 using a solar panel 102 and a cigarette lighter adapter 103. The solar panel 102 is an array of photovoltaic cells connected to a solar panel cable 156 and a solar panel cylindrical connector 158 that is designed to fit into the power connection 113. The solar panel 102 uses sunlight to generate the electricity, which is routed through the solar panel cable 156 and the solar panel cylindrical connector 158 to power the defroster 101. When sunlight is not available, a cigarette lighter adapter 103 can be plugged into the automobile's 129 electrical system. Attached to the cigarette lighter adapter 103 is a cigarette lighter cable 155 and a cigarette lighter cylindrical connector 157 that is designed to fit into the power connection 113. The cigarette lighter adapter 103 draws electricity from the automobile's 129 electrical system, which is routed through the cigarette lighter cable 155 and a cigarette lighter cylindrical connector 157 to power the defroster 101.

Commercially available solar panels 102 and cigarette lighter adapters 103 are used in the first potential embodiment of the disclosure.

To use the invention 100, the invention is removed from its carrying case 130, the one or more support rods 112 are placed in the window nook 127 and the defroster 101 is placed on the exterior side of the windshield 126. Either the solar panel 102 or the cigarette lighter adapter 103 is plugged into the power connector 113. The on off switch 114 is then turned on. The on off switch 114 turns on the one or more fans 105 and the heating element 104. The one or more fans 105 draw air through the fan grill 109 and pumps the air over the heating element 104 and through the heat exhaust vent 110 onto the windshield 126. The heated air melts the frost accumulated on the windshield 126.

With respect to the above description, it is to be realized that the optimum dimensional relationship for the various components of the invention described above and in FIGS. 1 through 6, include variations in size, materials, shape, form, function, and manner of operation, assembly and use, are deemed readily apparent and obvious to one skilled in the art, and all equivalent relationships to those illustrated in the drawings and described in the specification are intended to be encompassed by the invention.

It shall be noted that those skilled in the art will readily recognize numerous adaptations and modifications which can be made to the various embodiments of the present invention which will result in an improved invention, yet all of which will fall within the spirit and scope of the present invention as defined in the following claims. Accordingly, the invention is to be limited only by the scope of the following claims and their equivalents.

What is claimed is:

1. A portable windshield defrosting device comprising:

a defroster, a solar panel, and cigarette lighter adapter;

wherein the portable windshield defrosting device is adapted to be mounted on an exterior of an automobile windshield;

wherein the portable windshield defrosting device is adapted to remove condensation and ice from automobile windshields;

wherein the defroster comprises a heating element, at least one fan, and a housing; wherein the heating element heat air that is used to defrost the windshield and the at least one fan draws air into the housing and pumps the air over the heating element and onto the automobile windshield;

wherein the housing comprises a base structure, a fan ridge, a fan grill, a heat exhaust vent, a first end cap, a second end cap, and one or more support rods; wherein the base structure houses and encloses the heating element and acts as a platform to which the fan ridge, the heat exhaust vent, the first end cap, and the second end cap are attached and wherein the bottom surface of the base structure is formed with a heat exhaust vent comprising a series of holes formed in the bottom;

wherein the fan ridge is a substructure that projects away from the top surface of the base structure in the shape of a partial elliptical cylinder and houses the at least one fan and the fan grill;

wherein the first end cap is a structure that is fitted with a plurality of terminating posts, a plurality of jumpers, a power connection, an on off switch, and a first lift.

2. The portable windshield defrosting device according to claim 1 wherein the power connection distributes electrical energy to the heating element and the at least one fan.

3. The portable windshield defrosting device according to claim 2 wherein the power connection is a socket designed to receive a cylindrical connector; wherein the power connection delivers electrical energy through a positive feed wire and the on-off switch to the heating element and the at least one fan.

4. The portable windshield defrosting device according to claim 3 wherein the on off switch is placed in series between the power connection and the heating element.

5. The portable windshield defrosting device according to claim 4 wherein the first lift projects out from the first end cap to adaptively raise the bottom surface off of the automobile windshield.

6. The portable windshield defrosting device according to claim 5 wherein the second end cap is a structure that is fitted with a plurality of terminating posts, a plurality of jumpers, and a second lift.

7. The portable windshield defrosting device according to claim 6 wherein the second lift projects out from the first end cap to adaptively raise the bottom surface off of the automobile windshield.

8. The portable windshield defrosting device according to claim 7 wherein the one or more support rods are adaptively positioned between the windshield and a hood of an automobile.

9. The portable windshield defrosting device according to claim 8 wherein the heating element is comprised of a first nichrome wire, a second nichrome wire, and a third nichrome wire; wherein the first nichrome wire is further defined with a first end and a second end; wherein the second nichrome wire is further defined with a third end and a fourth end; and wherein the third nichrome wire is further defined with a fifth end and a sixth end.

10. The portable windshield defrosting device according to claim 9 the first end cap is fitted with a first terminating post, a third terminating post, and a fifth terminating post; wherein the second end cap is fitted with a second terminating post, a fourth terminating post, and a sixth terminating post.

11. The portable windshield defrosting device according to claim 10 wherein the first end is attached to the first terminating post; wherein the second end is attached to the second terminating post; wherein the third end is attached to the third terminating post; wherein the fourth end is attached to the fourth terminating post; wherein the fifth end is attached to the fifth terminating post; and wherein the sixth end is attached to the sixth terminating post.

12. The portable windshield defrosting device according to claim 11 wherein a first jumper wire is used to connect the third terminating post and the fifth terminating post; a second jumper wire is used to connect the second terminating post and the fourth terminating post; and the first terminating post to the on off switch and connecting the sixth terminating post to the ground return wire.

13. The portable windshield defrosting device according to claim 10 wherein electrical power is provided via a solar panel.

14. The portable windshield defrosting device according to claim 12 wherein electrical power is provided via a cigarette lighter adapter that is adapted to plug into an electrical system of said automobile.

* * * * *